US006692271B2

(12) United States Patent
Watanabe

(10) Patent No.: US 6,692,271 B2
(45) Date of Patent: Feb. 17, 2004

(54) CARD CONNECTOR GROUNDING ASSEMBLY

(75) Inventor: Yoshinori Watanabe, Kanagawa (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/970,569

(22) Filed: Oct. 4, 2001

(65) Prior Publication Data

US 2002/0042217 A1 Apr. 11, 2002

(30) Foreign Application Priority Data

Oct. 6, 2000 (JP) ..... 2000-308312

(51) Int. Cl.[7] ..... H01R 13/648; H01R 13/60; H01R 13/66

(52) U.S. Cl. ..... 439/108; 439/607; 439/541.5

(58) Field of Search ..... 439/607, 541.5, 439/159, 108

(56) References Cited

U.S. PATENT DOCUMENTS 5,288,247 A 2/1994 Kaufman ..... 439/607
6,183,273 B1 * 2/2001 Yu et al. ..... 439/541.5
6,234,809 B1 * 5/2001 Futatsugi ..... 439/64

FOREIGN PATENT DOCUMENTS

WO WO 96/27920 9/1996 ..... H01R/13/658

* cited by examiner

*Primary Examiner*—Chandrika Prasad

(57) ABSTRACT

A card connector assembly having intermediate contacts with dimensions corresponding to the attachment height at which an insulating housing that accommodates a card is attached to a board. Signal contacts are attached to the insulating housing and are connected to the card. A ground plate is ground-connected with the card. The contacts and the ground plate are connected to the board. Intermediate contacts are disposed in the insulating housing. One end of each of the intermediate contacts is ground-connected to the board. The ground plate is ground-connected to the board via the intermediate contacts. Accordingly, even if the attachment height at which the connector assembly is attached to the board should vary, the dimensions of the intermediate contacts can easily be adjusted to accommodate the difference in height.

19 Claims, 8 Drawing Sheets

CARD CONNECTOR GROUNDING ASSEMBLY

BACKGROUND OF THE INVENTION

The present invention relates to a card connector assembly, and more specifically, to a board-attached type card connector assembly attached to a board.

DESCRIPTION OF THE PRIOR ART

A conventional board-attached type card connector assembly has numerous contacts that are directly soldered to a board and disposed in an insulating housing. The insulating housing accommodates a card (memory card). The card is ground to the board via spring fingers that contact the metal surfaces (frame ground) on the side surfaces and attachment brackets that are connected to the spring fingers. The ground frame discharges any charge accumulating on the card, so that the integrated circuits (IC) in the card are protected from static electricity. One embodiment of this type of assembly is disclosed in U.S. Pat. No. 5,288,247. A second type of assembly is disclosed in Japanese Patent Application Kokai No. H8-241764. The second assembly has signal grounds located in the vicinity of the front end of the card that contact a ground plate. The ground plate is connected to the board via a flexible wiring board and relay connector. The signal contacts are similarly connected to the board via the flexible wiring board and a relay connector that is connected to the wiring board.

A board mount card connector assembly requires a plurality of different attachment heights for a card connector assembly depending on the desired application. Because the parts in which the spring fingers and attachment brackets are connected cannot handle a plurality of types of card connectors with different heights, a plurality of different types of card connector assemblies and molds must be prepared according to the attachment height. Although variations in height can be handled more easily by the flexible circuit board, the number of parts required is still extensive, thereby increasing manufacturing costs.

It is therefore desirable to develop an inexpensive board mount card connector assembly that can accommodate various attachment heights of the board mount card connector assembly to the board.

SUMMARY OF THE INVENTION

This invention relates to a board mount card connector assembly having an insulating housing that accommodates a card attached to a board. Signal contacts are attached to the insulating housing and are connected to the card that is inserted into the insulating housing. A ground plate is ground-connected with the card. The contacts and the ground plate are connected to the board. Intermediate contacts are disposed in the insulating housing and have dimensions corresponding to the attachment height at which the insulating housing is attached to the board. One end of each of the intermediate contacts is ground-connected to the board. The ground plate is ground-connected to the board via the intermediate contacts.

DETAILED DESCRIPTION OF THE PREFERRED EMBODIMENT

Figure 1A:
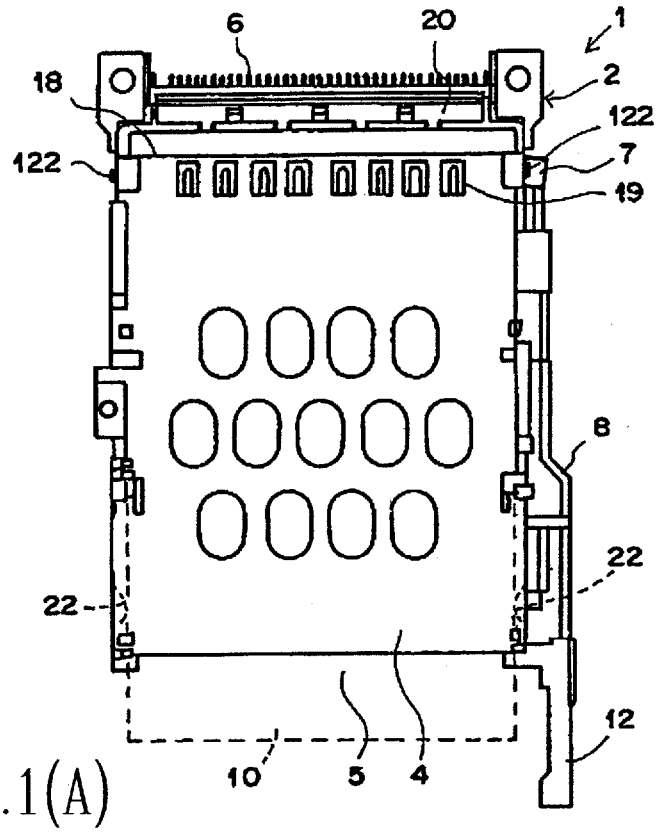
FIG. 1(A) is a schematic plan view of the card connector assembly.

Shown in FIG. 1, the assembly 1 is equipped with an insulating housing 2 that has signal contacts 6 in the rear part. A metal shielding shell (frame) 4 is attached to the front part of the housing 2. The shell 4 is formed so that it is substantially plate-shaped, and is constructed so that a card 10 (i.e., memory or PC card) can be accommodated inside via an opening in the front part 5. The shell 4 surrounds the card, meaning that the card can either be completely covered or partially exposed to the outside. Guides are disposed on both the left and right sides of the shell 4 to guide the card. The guides are formed by metal members that are integral parts of the shell 4 or by a synthetic resin. In this case, the left and right guides of the shell 4 guide the card 10.

An operating rod 8 is attached to the shell 4 and has a knob 12 on its tip end so that the rod 8 is free to slide. The end portion 7 of a cam bar is connected to the tip end of the operating rod 8 and is accommodated inside the housing 2 so that the cam bar is free to rotate. When the knob 12 is pushed, the cam bar is driven, ejecting the card 10 inserted into the shell 4.

Figure 1B:
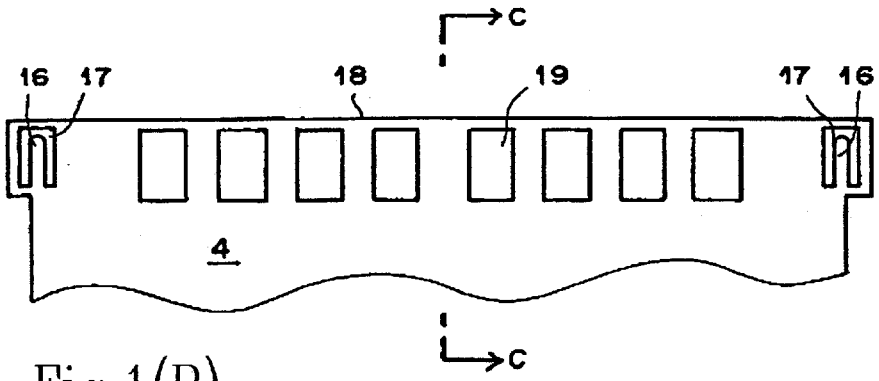
FIG. 1(B) is a partial enlarged view showing an enlargement of the rear part of the shielding shell used in the card connector assembly.
Figure 1C:
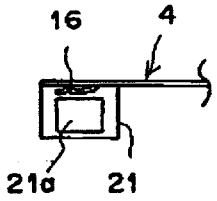
FIG. 1(C) is a sectional view of the shielding shell along line C—C of FIG. 1(B).

The ground connection of the card 10 will now be described. A metal plate (not shown) covers the outside of the card 10. When the card 10 is inserted into the shell 4, the metal plate contacts spring parts 22 that protrude inside the shell 4. Tongue parts (conductive parts) 16, shown in FIG. 1(B), are formed by being cut and raised inside rectangular openings 17 on both sides of the shell 4 near the rear edge 18 of the shell 4. The tongue parts 16 extend rearward and are inclined toward the housing 2.

A ground plate 20 is carried on the upper surface of the housing 2. The shell 4 is attached to the surface of the ground plate 20. Electrical continuity is established when the tongue parts 16 contact the ground plate 20. Here, the surface of the ground plate 20 that contacts the tongue parts 16 acts as a conductive part. As a result, the outer surface of the card 10, the shell 4, and the ground plate 20 are electrically connected so that the parts form an integrated unit in electrical terms.

Figure 5:
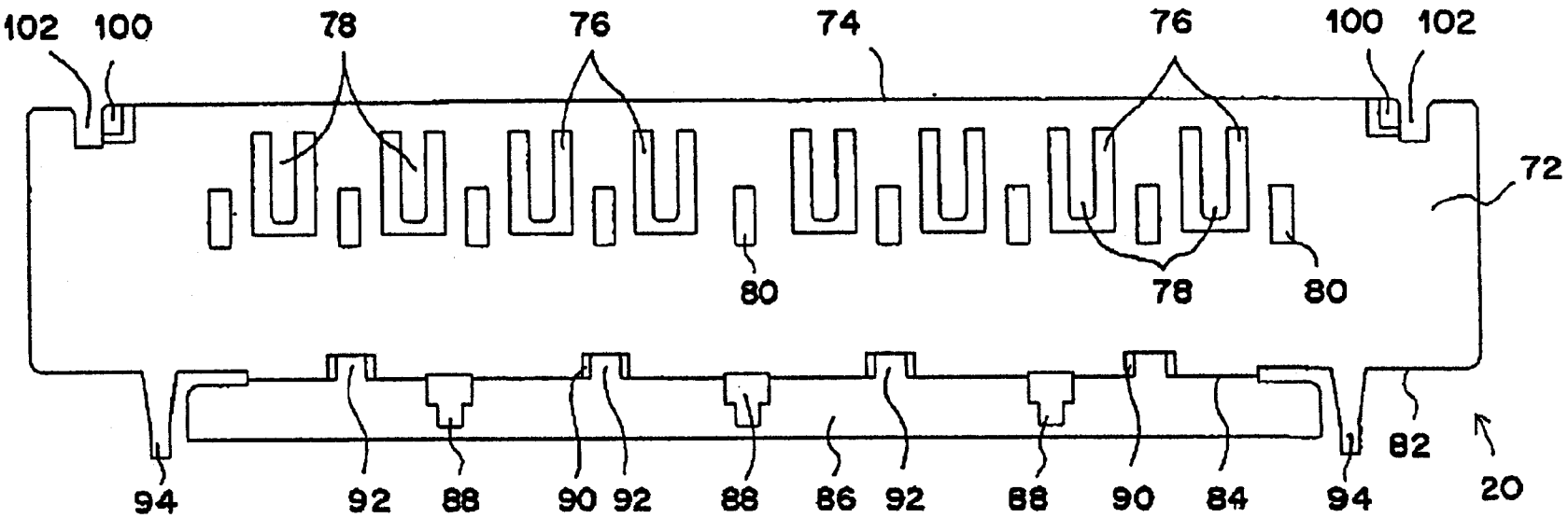
FIG. 5 is a plan view of the ground plate.
Figure 7:
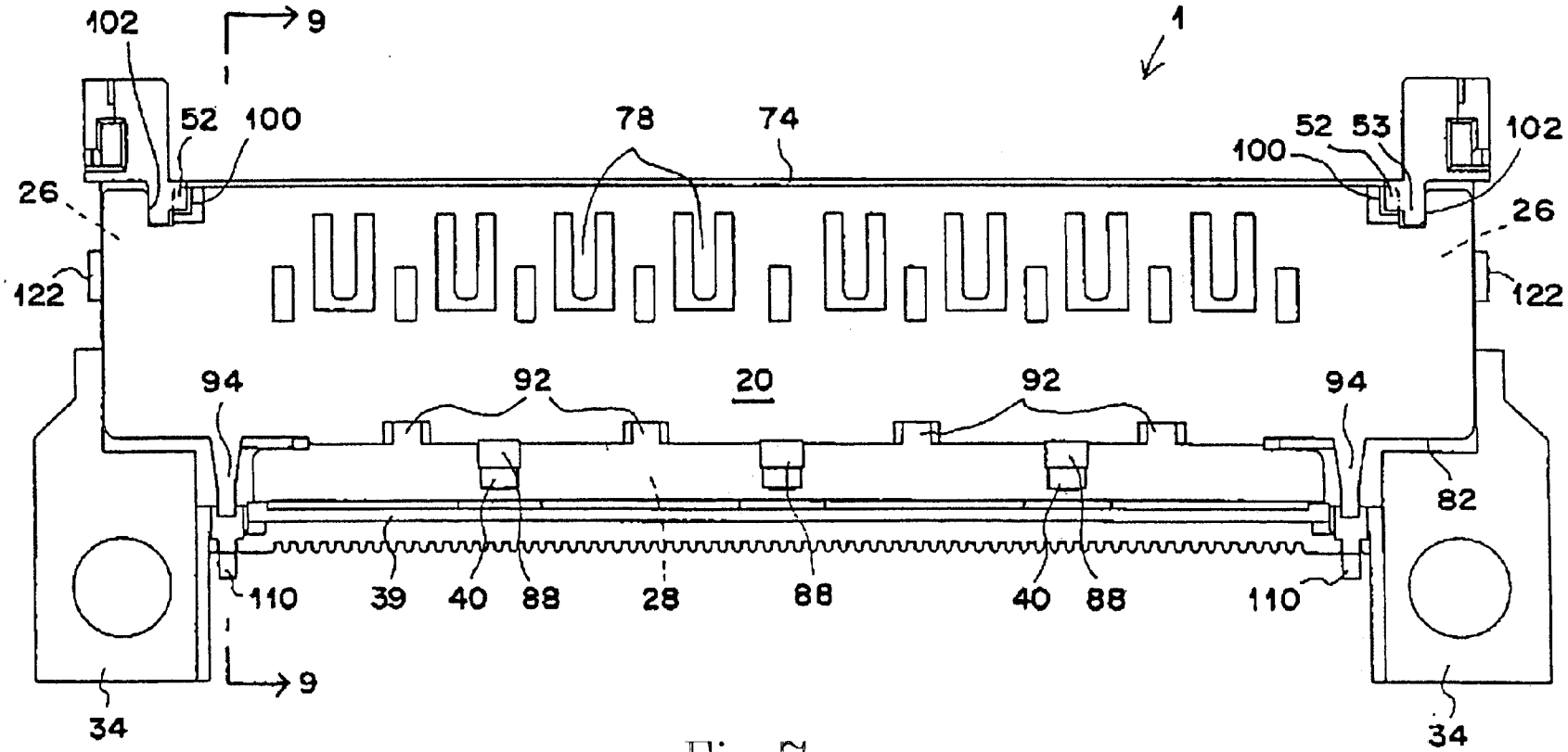
FIG. 7 is a plan view of the card connector assembly.

A plurality of rectangular openings 19 is formed along the rear edge 18 of the shell 4. To allow for the proper displacement of the tongue parts 78, the openings 19 are formed in positions corresponding to the tongue parts 78 on the ground plate 20 (FIGS. 5 and 7). Latch parts 21 having rectangular openings 21*a* are formed by being bent toward the housing on both sides of the rear edge 18 of the shell 4 (FIG. 1(C)). The latch parts 21 engage with latching projections 122 (FIGS. 1(A), 3 and 8) of the housing 2, fastening the shell 4 to the housing 2.

Figure 2:
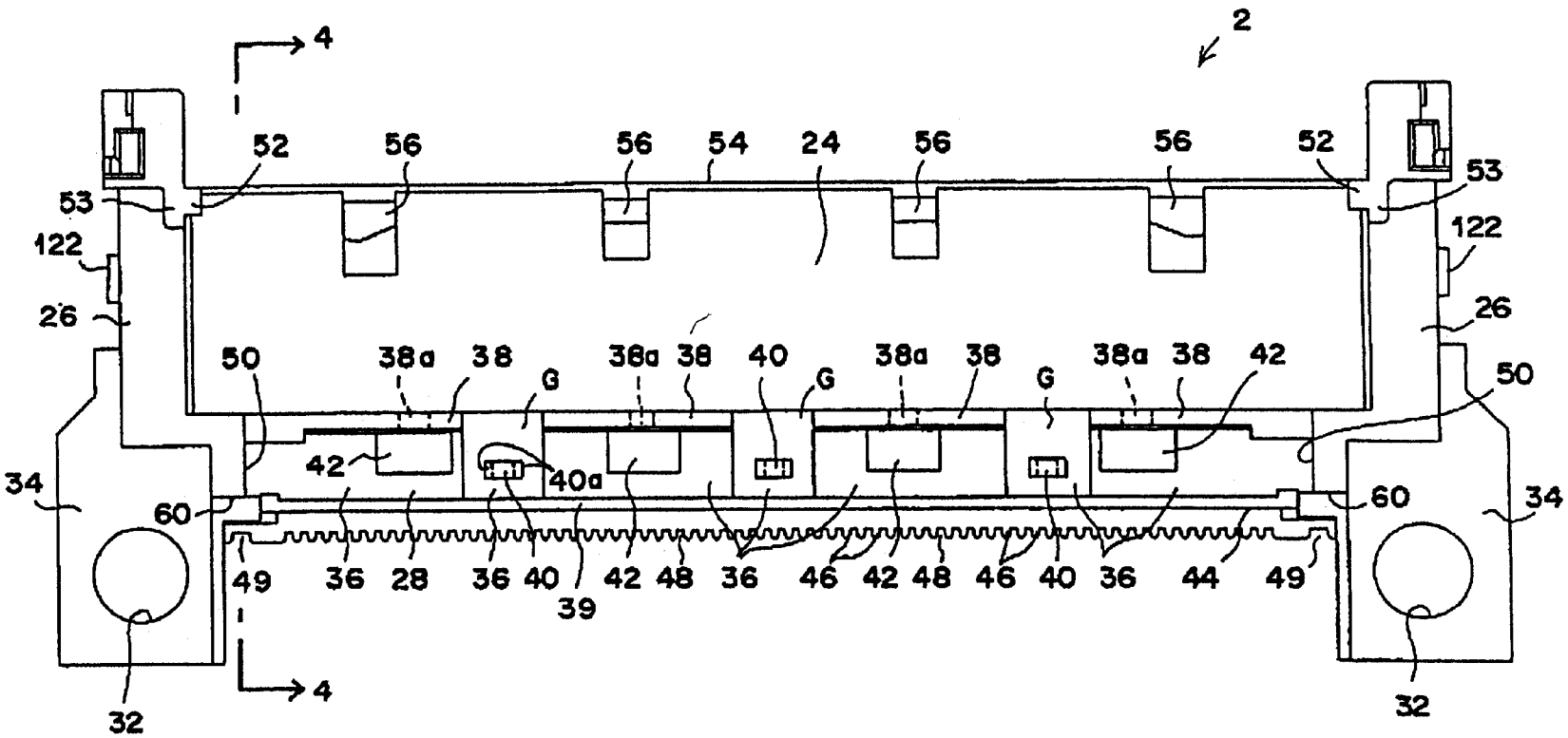
FIG. 2 is a plan view of the insulating housing of the card connector assembly shown in FIG. 1.
Figure 3:
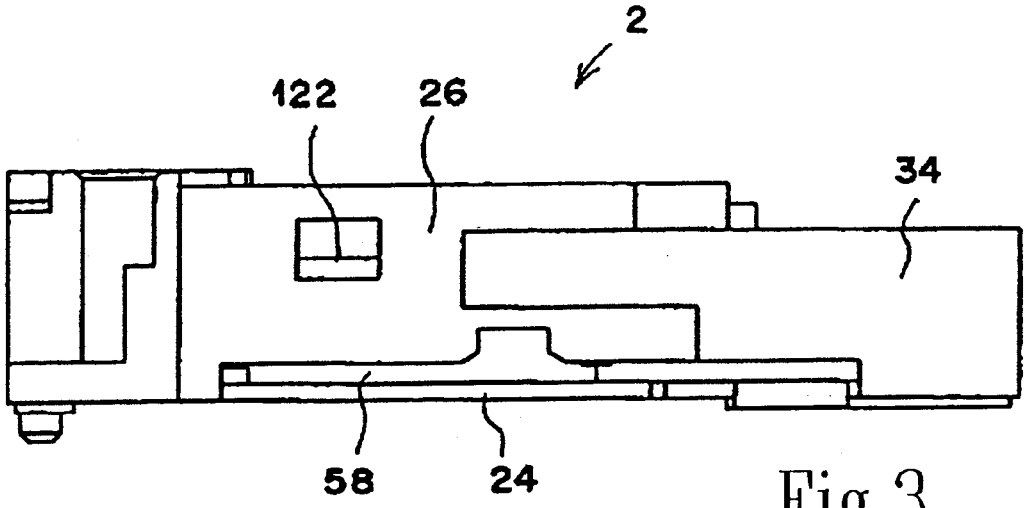
FIG. 3 is a side view of the insulating housing shown in FIG. 2.

The housing 2 of the assembly 1 will be described with reference to FIGS. 2 through 4. The shape of the housing 2, as seen in a plan view, is a long, slender, substantially rectangular shape (FIG. 2). In the housing 2, a bottom wall 24, side walls 26 positioned on both sides of the bottom wall 24, and a rear wall 28 connecting both side walls 26, 26, are molded as an integral unit from a synthetic resin. On the rear parts of both ends of the housing 2, rectangular attachment seats 34, in which holes 32 are formed, are molded as integral units with the side walls 26 and rear wall 28. The upper side of the housing 2 forms a space causing the area to the front of the rear wall 28 to be open.

A recessed surface 36 formed substantially in the same plane in the upper surface of the rear wall 28, drops slightly downward from the upper surfaces of both side walls 26 via steps 50. Ribs 38 are formed at specified intervals on the front part of the rear wall 28 and protrude slightly from the recessed surface 36. Three projections 40 are formed on the recessed surface 36 in positions that correspond to the gaps G between the ribs 38 and are located to the rear of the ribs 38 (below the ribs in FIG. 2). The projections 40 have a cross-sectional T shape, and have grooves 40*a* on both sides. A long, narrow extended slot 38*a* is formed along the recessed surface 36 in each rib 38 and passes through each rib 38 in the forward-rearward direction. A recessed part 42, which is slightly lower than the recessed surface 36, is formed in the recessed surface 36 behind each of the slots 38*a*. The slots 38*a* are positioned at the same height as the recessed parts 42. A rib 39 is caused to protrude from the rear end of the rear wall 28. The rib 39 extends along substantially the entire length of the rear wall 28 of the housing 2.

A plurality of holding projections 46 are formed along the rear wall 28 on the rear end 44 of the housing 2. Holding grooves 48 are formed between adjacent holding projections 46 and position the contacts 6. At both ends of the row of holding grooves 48, cut-outs 49 are formed in positions corresponding to the rear-facing surfaces 60 of the rear part of the housing 2.

Rectangular tongue parts 52 are caused to protrude inward, parallel to the bottom wall 24, on the insides and near the tip ends of the respective side walls 26. Rectangular protruding parts 53 that have the same height as the rectangular tongue parts 52 are formed on the respective side walls 26. Flat projections 56 protrude from the bottom wall 24 at substantially uniform intervals. The projections 56 regulate the swinging motion of the cam bar disposed on the bottom wall 24. A slot 58, extending in the forward-rearward direction, is formed on the side wall 26 in the vicinity of the bottom wall 24 (FIG. 3). The cam bar protrudes from the slot 58 and is connected to the operating rod 8.

Figure 4:
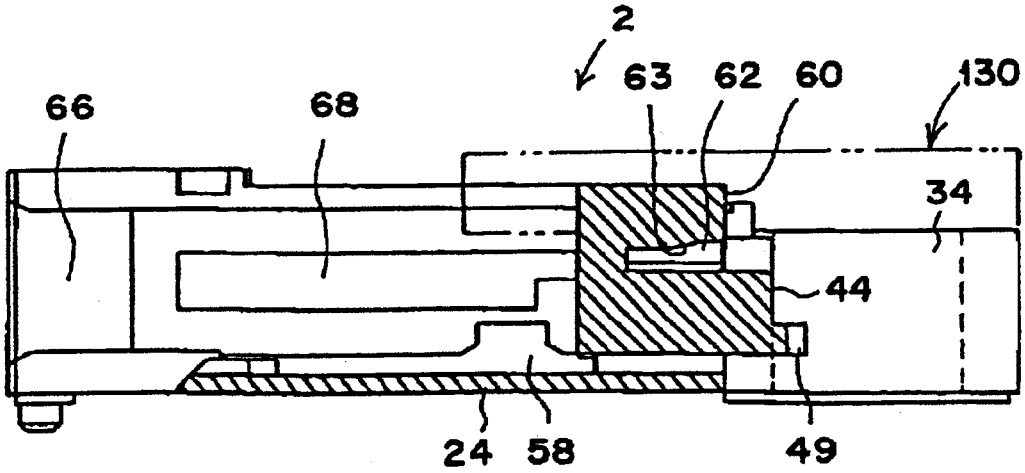
FIG. 4 is a sectional view of the insulating housing along line 4—4 of FIG. 2.

Shown in FIG. 4, recessed grooves 62 are formed at both ends of the row of holding projections 46 of the housing 2. The recessed groves 62 extend forward (to the left in FIG. 4) parallel to the bottom wall 24 from the rear-facing surface 60 of the housing 2. The inside surface on the lower side of the groove is formed parallel to the bottom wall 24, while the inside surface on the upper side is formed with a taper 63 so that the groove becomes narrower moving inward. The housing 4 contains an opening 66 for insertion of the card 10 (FIG. 4). A projecting strip 68, used to prevent erroneous insertion of the card 10, protrudes inward and is formed from a long, slender part that extends in the forward-rearward direction on the inside surface of one side wall 26. A second projecting strip protrudes on the opposite side wall opposite from the projecting strip 68.

Figure 6:
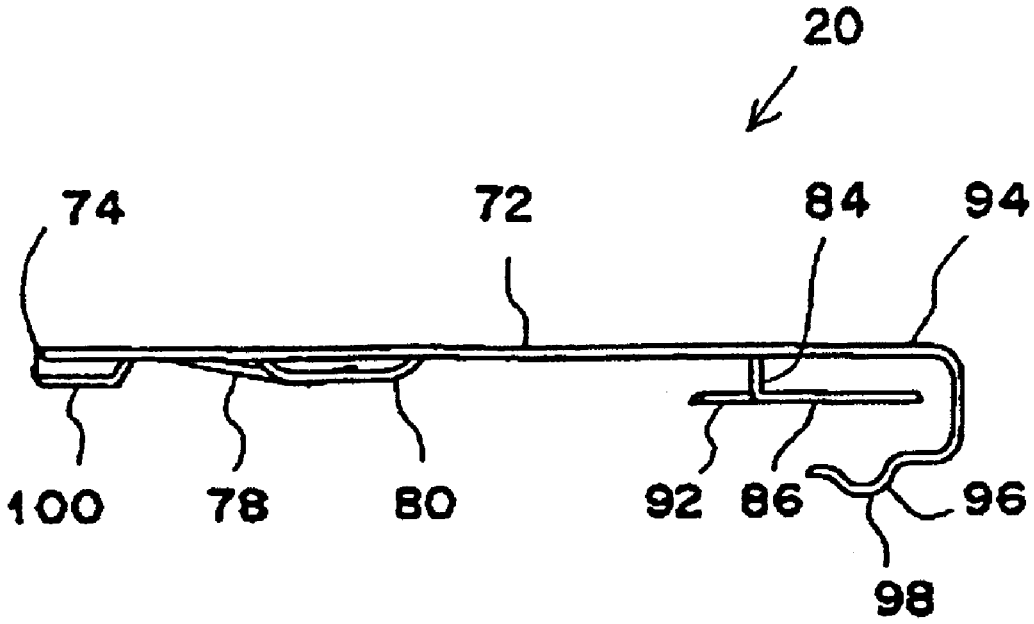
FIG. 6 is a side view of the ground plate.

The upper surface of the housing 2 carries a ground plate 20 (FIGS. 5 and 6). The ground plate 20 is substantially rectangular in shape and is formed by stamping and bending a single metal plate. A plurality of rectangular openings 76 is formed along the front edge 74 of the main surface 72 of the ground plate 20 in the vicinity of the front edge 74. Tongue parts (contact parts) 78 are formed in the openings 76 and extend rearward. Projections 80 protrude downward from the main surface 72 (i.e., toward the housing 2) and are formed by stamping between adjacent openings 76. The projections 80 limit the upward movement of the card 10 in order to prevent the card 10 from interfering with and deforming the tongue parts 78 when the card 10 is removed. The projections 80 also prevent a decrease in the strength of the ground plate 20 from the formation of numerous openings 76.

On the rear edge 82 of the ground plate 20, an extension part 86 drops slightly toward the opposite side of the plane of the page as a result of a step part 84 formed parallel to the main surface 72 as an integral part along the rear edge 82. T-shaped holes 88 are formed in the extension part 86 in positions corresponding to the T-shaped projections 40. Cut-outs 90 are formed adjacent to the respective T-shaped holes 88 in positions corresponding to the slots 38*a*. Anchoring parts 92 extend in the opposite direction from the extension part 86. The anchoring parts 92 protrude into the cut-outs 90. Grounding tongue parts 94 protrude near both ends of the rear edge 82. The grounding tongue parts extend rearward and are then bent back forward in an approximate U shape (FIG. 6). Contact parts 96 are formed on the lower side as a result of the grounding tongue parts 94 being bent. The contact parts 96 have bent contact points 98 that are bent so that the contact points protrude downward. Rectangular recesses 100 are formed adjacent to cut-outs 102 which open to the front near both ends of the front edge 74 of the ground plate 20.

Figure 8:
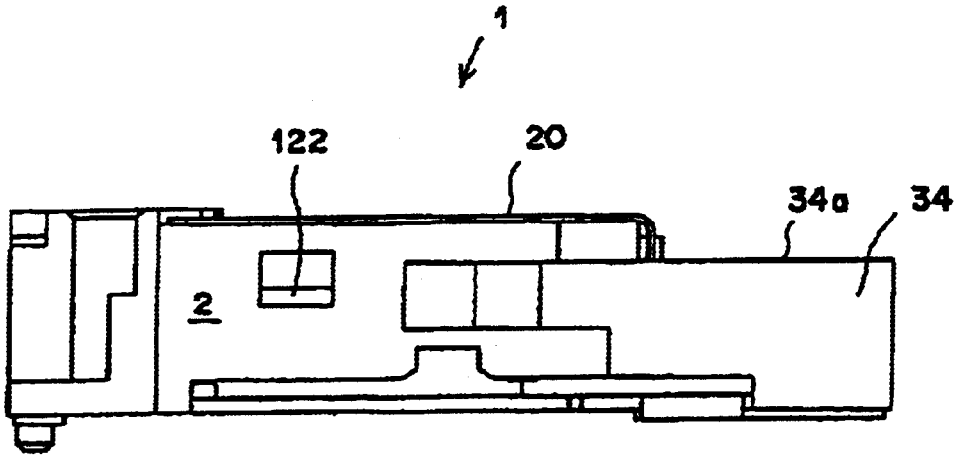
FIG. 8 is a side view of the card connector assembly shown in FIG. 7.

The assembly 1 in which the ground plate 20 is attached to the housing 2 will be described with reference to FIGS. 7 through 9. The assembly 1 is shown with the contacts 6 omitted.

The ground plate 20 is placed on the side walls 26 and rear wall 28. The holes 88 in the ground plate 20 are engaged by the T-shaped projections 40 of the housing 2. The anchoring parts 92 engage with the slots 38*a* to prevent the separation of the rear edge 82 of the ground plate 20 from the housing 2. The cut-outs 102 of the ground plate 20 engage with the protruding parts 53 of the housing 2. The recesses 100 are engaged beneath the rectangular tongue parts 52 of the housing 2, so that the separation of the front edge 74 of the ground plate 20 from the housing 2 in the upward direction is prevented. As a result of the engagement of the protruding parts 53 and the cut-outs 102 as well as the engagement of the extension part 86 and the rib 39, the movement of the ground plate 20 in the forward-rearward direction is stabilised.

Figure 9:
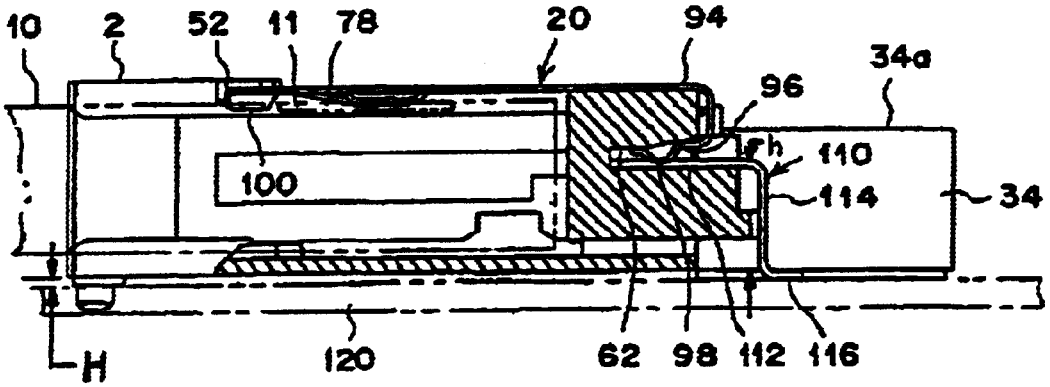
FIG. 9 is a sectional view of the card connector assembly along line 9—9 of FIG. 7.
Figure 10:
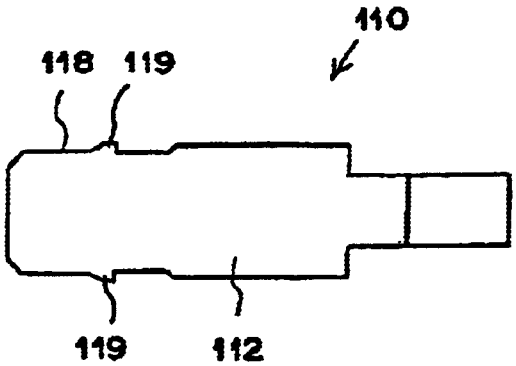
FIG. 10 is a plan view of a first intermediate contact used in the card connector assembly.
Figure 11:
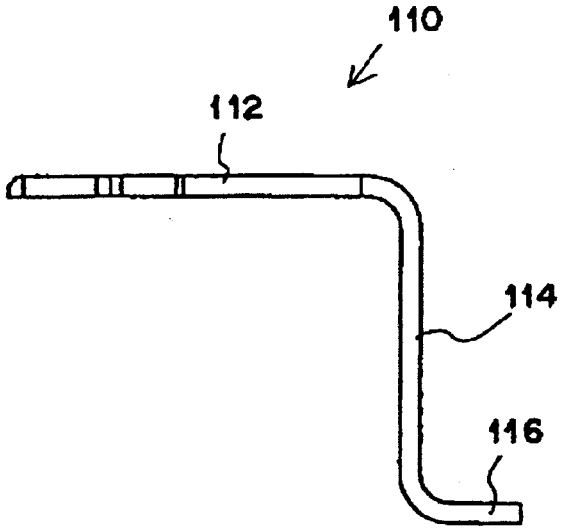
FIG. 11 is a side view of the first intermediate contact shown in FIG. 10.

In this case, shown most clearly in FIG. 9, the contact parts 96 of the grounding tongue parts 94 of the ground plate 20 are disposed inside the recessed grooves 62 of the housing 2. The intermediate contacts 110 are press-fitted inside the recessed grooves 62 (FIGS. 10 and 11). Each intermediate contact 110 is formed by stamping and bending from a single metal plate, and has a long, slender, substantially rectangular press-fitting part 112. A leg part 114 is bent downward at right angles from this press-fitting part 112 (in FIG. 11). A tine part (solder connection part) 116 is bent parallel to the press-fitting part 112 and in the opposite direction from the press-fitting part at the lower end of the leg part 114. The leg part 114 and tine part 116 have the same width, which is narrower than the width of the press-fitting part 112.

The press-fitting part 112 has a barb 119 on each side edge 118. The press-fitting part 112 is press-fitted in the recessed groove 62 causing the inside walls of the recessed grooves 62 and the barbs 119 to interfere and engage with each other, so that the press-fitting part is held inside the recessed groove 62. Further, when the press-fitting part 112 is press-fitted in the recessed groove 62, the bent contact point 98 is pushed upward and the press-fitting part 112 makes electrical contact with the bent contact point 98 (FIG. 9).

The tine part 116 is positioned on the pad of a circuit trace (not shown) on the board 120 that is attached to the assembly 1. The leg part 114 is held in the cut-out 49 of the housing 2, so that the tine part 116 is accurately positioned on the pad. As a result, the ground plate 20 is ground-connected to the board 120 via the intermediate contacts 110.

Since the intermediate contacts 110 have relatively short dimensions, the coplanarity (i.e., the dimensional precision of the height of the tine parts 116) can be increased, so that the planarity with the tine parts of the contacts 6 can be increased. Further, in cases where the attachment height H at which the housing 2 is attached to the board 120 varies, it is necessary to change only the shape of the contacts 6 and the dimensions h of the leg parts 114 of the intermediate contacts 110. Hence, there is no need to manufacture a plurality of different types of ground plates 20 with complicated shapes and large dimensions. The same ground plate 20 can be applied to different types of assemblies.

In cases where the card 10 has signal grounds 11 near the tip end portion of the card 10 (FIG. 9), the tongue parts 78 contact the signal grounds 11, so that a ground connection is established with the board 120 via the ground plate 20 and intermediate contacts 110. Similarly, the grounds on the outside surface of the card 10 (i.e., the frame grounds) are ground connected to the board 120 via the intermediate contacts 110 as a result of the contact between the outside surface of the card and the spring parts 22, and the contact between the tongue parts 16 and the ground plate 20. In the alternative, instead of using both ground connections, either one or the other of the ground connections could be used (i.e., signal grounds and frame grounds).

Figure 12:
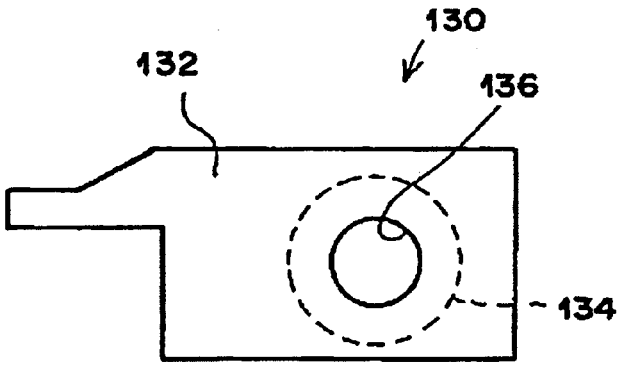
FIG. 12 is a plan view of a first nut used in the card connector assembly of the present invention.
Figure 13:
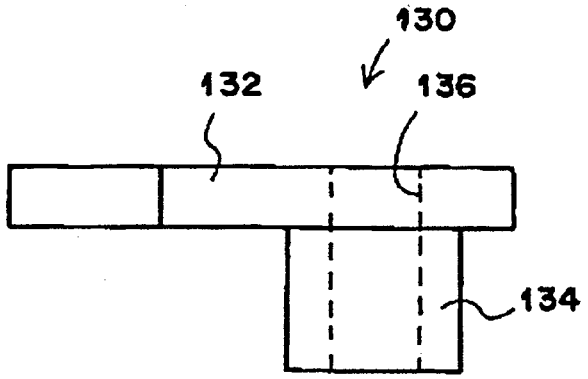
FIG. 13 is a front view of the first nut shown in FIG. 12.

The support nuts 130 that are mounted on the attachment seats 34 of the housing 2 will be described with reference to FIGS. 12 and 13. Each nut 130 is carried on the corresponding attachment seat 34. The nut 130 is fastened by means of a bolt (not shown) from the side of the board 120, so that the attachment seat 34 and board 120 are fastened together, fastening the assembly 1 to the board 120. The nuts 130 have a shape that is similar to the shape of the attachment seats 34 and two types of nuts are prepared in accordance with the left and right attachment seats 34 (FIG. 12 shows the nut 130 corresponding to the right-side attachment seat 34 in FIG. 2). The nut 130 is an aluminium die-cast part, and has a flat part 132 with the same shape as the attachment seat. A tubular part 134 protrudes downward from the flat part 132 as an integral part of the flat part 132 in a position corresponding to the hole 32 in the flat part 132.

The external diameter of the tubular part 134 is sized so that it may be inserted into the hole 32 of the corresponding attachment seat 34. A female screw 136 is formed on the inside of the tubular part 134 and engages with the bolt. When the nut 130 is mounted on the attachment seat 34, so that the tubular part 134 is inserted into the hole 32, the nut 130 is positioned as shown by the dashed line in FIG. 4. Since the nut 130 is die-cast, the attachment strength is extremely high, and the impact resistance is large. Hence, even if a large impact is applied to the attachment part, for example as a result of a device equipped with the assembly being dropped, damage is prevented.

I claim:

1. A card connector assembly comprising:

an insulating housing attached to a board and having a card accommodating recess, a ground plate disposed on the insulating housing, the ground plate having a contact part and a grounding tongue part, the contact part formed to contact a card received in the card accommodating recess; and an intermediate contact press-fitted inside recessed grooves of the insulating housing and having a first end that contacts the grounding tongue part and a second end that contacts the board to form a ground path from the ground plate to the board, the intermediate contact having a height dimensions directly proportional to a height at which the insulating housing is attached to the board.

2. The card connector assembly of in claim 1 wherein the has contact parts are tongue parts that are formed by being cut and raised from the ground plate.

3. The card connector assembly of in claim 1 further comprising a shielding shell which surrounds the card and is disposed on the insulating housing, the shielding shell and the ground plate are electrically connected to each other via conductive parts.

4. The card connector assembly of claim 3 wherein the conductive parts are tongue parts that are cut and raised from the shielding shell and contact a surface of the ground plate.

5. The card connector assembly of claim 1 wherein the ground plate has projections that protrude downward from the main surface of the ground plate to limit upward movement of the card.

6. The card connector assembly of claim 5 wherein the projections are formed by stamping between adjacent openings on the ground plate.

7. The card connector assembly of claim 1 wherein the grounding tongue part extends from a rear edge of the ground plate and extends rearward and is then bent back forward in an approximate U shape to form a contact part on a lower side of the ground plate.

8. The card connector assembly of claim 7 wherein the contact part has a bent contact point that is bent so the contact point protrudes downward to engage the first end of the intermediate contacts.

9. The card connector assembly of claim 7 wherein the contact parts of the grounding tongue part of the ground plate is disposed inside a recessed groove of the housing.

10. The card connector assembly of claim 1 wherein the intermediate contacts are formed from stamping and bending a metal plate and have long, slender, substantially rectangular press-fitting parts.

11. The card connector assembly of claim 1 wherein the intermediate contact has a leg part that extends between the first end and the second end, the first end and the second end formed at a substantially right angle from the leg part.

12. The card connector assembly of claim 11 wherein the second end has a tine part bent parallel to the first end and in the opposite direction from the first end at a lower end of the leg part.

13. The card connector assembly of claim 1 wherein the intermediate contact has barbs extending from side edges, the barbs engage the recessed groove of the insulating housing causing inside walls of the recessed groove and the barbs to interfere and engage with each other so that the intermediate contact is press-fitted inside the recessed groove.

14. The card connector assembly of claim 1, wherein the intermediate contact includes a leg part that extends between the first end and the second end, the leg part has a length that is increased or decreased so that the second end contacts the board.

15. The card connector assembly comprising:

an insulating housing having a card accommodating recess;

a ground plate fixed to atop surface of the insulating housing, the ground plate having a contact part that extends into the card accommodating recess to contact a card and a grounding tongue part that is received in a recess in the insulating housing;

an intermediate contact having a first end that contacts the grounding tongue part and a second end that contacts a board to form a ground path from the ground plate to the board, the intermediate contact having a height dimension directly proportional to a height at which the insulating housing is attached to the board; and the intermediate contact includes a leg part that extends from the first end to the second end, and the first end and the second end are positioned essentially normal to the leg part.

16. The card connector assembly of claim 15, wherein the leg part may be increased in length so that the second end contacts the board.

17. The card connector assembly of claim 15 wherein when ground plate includes anchoring parts that fix the ground plate to insulating housing and prevent movement of the ground plate parallel to the top surface of the insulating housing.

18. The card connector assembly of claim 15, wherein the grounding tongue part is essentially u-shaped and extends from a rear surface of the ground plate.

19. A card connector assembly comprising:

an insulating housing attached to a board and having a card accommodating recess;

a ground plate disposed on the insulating housing, the ground plate having a contact part and a ground tongue part, the contact part formed to contact a card received in the card accommodating recess; and an intermediate contact press-fitted into the insulating housing and having a first end that directly contacts the grounding tongue part and a second end that directly contacts a board to form a ground path from the ground plate to the board, the intermediate contact includes a leg part that extends between the first end and the second end, the leg part has a height corresponding to a distance between the grounding tongue part and the board.

* * * * *